US007793378B1

(12) United States Patent
Kirby

(10) Patent No.: US 7,793,378 B1
(45) Date of Patent: Sep. 14, 2010

(54) EXCESS GROUT AND CEMENT REMOVER, PACKER, PROFILER AND SPACER

(76) Inventor: Mark E. Kirby, 2297 Jones Dr., Dunedin, FL (US) 34698

( * ) Notice: Subject to any disclaimer, the term of this patent is extended or adjusted under 35 U.S.C. 154(b) by 1200 days.

(21) Appl. No.: 11/160,985

(22) Filed: Jul. 19, 2005

(51) Int. Cl.
*A47L 1/06* (2006.01)

(52) U.S. Cl. ..... 15/105; 15/236.02; 15/111; 254/18; 29/270

(58) Field of Classification Search ..... 15/105, 15/236.02, 111, 117, 144.1, 172, 113; 81/427.5; 254/18; 29/270
See application file for complete search history.

(56) References Cited

U.S. PATENT DOCUMENTS 3,774,252 A * 11/1973 Cantales ..... 7/105
4,768,254 A * 9/1988 Bell ..... 15/236.01
5,865,077 A * 2/1999 Moffitt et al. ..... 81/427.5
6,134,743 A * 10/2000 Schmidt ..... 15/236.01
6,202,518 B1 * 3/2001 Moffitt et al. ..... 81/427.5
6,629,684 B2 * 10/2003 Youngren et al. ..... 254/19
6,668,751 B1 * 12/2003 Henke ..... 116/200
6,996,868 B1 * 2/2006 Milano et al. ..... 7/105

* cited by examiner

*Primary Examiner*—Lee D Wilson
(74) *Attorney, Agent, or Firm*—Ronald E. Smith; Smith & Hopen, P.A.

(57) ABSTRACT

A combination tool having utility in tile installation procedures includes a wide blade adapted to remove excess grout and caulk in relatively large quantities, a four-armed cement remover and grout joint spacer, a spherical grout packer and a "V"-shaped grout and caulk profiler adapted to be secured to a hollow handle in varying combinations. In a first embodiment, the wide blade is attached to a first end of the handle and the four-armed cement remover-grout joint spacer and the spherical packer are releasably secured to a second end of the handle. A second embodiment includes the blade at the first end and the "V"-shaped profiler at the second end in lieu of the cement remover and packer. The hollow handle provides a storage compartment for additional packers. The tool may be made of material that floats in water. The handle may also have a non-hollow web construction.

10 Claims, 8 Drawing Sheets

PRIOR ART

EXCESS GROUT AND CEMENT REMOVER, PACKER, PROFILER AND SPACER

FIELD OF THE INVENTION

This invention relates, generally, to the art of tile installation. More particularly, it relates to a combination tool that performs multiple functions to enable a tile installer to complete a job more efficiently.

DESCRIPTION OF THE PRIOR ART

Tile is typically held in place by cement, also known as mud, or other suitable adhesives such as epoxy, mastic, and the like.

Grout is a non-adhesive material that is applied between tiles. Grout is not flexible, and cannot expand and contract with changing temperatures. To allow sufficient curing time for the adhesive, grout is usually applied about fourteen (14) to sixteen (16) hours after the tile has been set.

Excess grout is removed when the installation has been completed and an aesthetically-pleasing profile is applied to the grout that is not removed.

Caulk is flexible, and expands and contracts with changing temperatures. It is typically applied, usually with a caulking gun, along a straight line where a vertical wall meets a horizontal floor, where two vertical walls meet in a corner, and so on.

An aesthetically-pleasing profile is usually applied to the caulk as well at the conclusion of the job.

The common flat head screwdriver is commonly used to clean out excess grout and to apply a profile to it to complete a job. However, due to the small flat area provided by a conventional screwdriver, only a small amount of excess grout can be removed at any one time. After excess grout is removed, the screwdriver may then be used as a profiler to apply a more pleasing profile to the grout that remains in position.

Another drawback of screwdrivers is that they are metallic and thus can easily form scratches in whatever surface they traverse.

Another tool in common use has a handle and stem that looks like a screwdriver handle and stem, but which terminates at its distal free end with a metallic cement scraper having the shape of a triangle. The corners of the triangle have utility in removing cement but have no utility in spacing tiles from one another.

After grout and caulk have been applied, a tool known as a grout/caulk packer is used to form a concavity along the linear extent of the grout and caulk. The tool includes a spherical member mounted to the distal end of a handle. This tool has utility when used at the last step of a tile installation because it imparts an aesthetically-pleasing appearance to the job.

It would therefore be advantageous if a packer tool could be combined with a tool for removing and profiling excess grout and with a tool that removes cement that bleeds into the spaces between tiles and that provide a tile-spacing function.

Another tool having utility in tile installation is known as a profiler. It too is formed of plastic so that it does not scratch tile. A notch formed in the leading end of the profiler applies an elongate, aesthetically-pleasing "bead" profile to the grout and caulk that is left in place as excess grout and caulk is removed. The depth of the notch may be cut to size as desired to increase the size of the bead. Significantly, the profiler tool removes excess grout and caulk and applies a profile to the remaining grout and caulk in one step.

It would therefore be advantageous to combine the profiler with an improved tool for removing excess grout.

However, in view of the prior art considered as a whole at the time the present invention was made, it was not obvious to those of ordinary skill in the pertinent art that a combination tool having an improved tool for the removal of excess grout should be combined with a tool for removing excess cement and for providing spacing between tiles and a spherical packer tool or with a "V"-shaped profiler tool.

SUMMARY OF THE INVENTION

The long-standing but heretofore unfulfilled need for a tool that facilitates tile installation is now met by a new, useful, and nonobvious invention.

In a first embodiment, a novel tool for removing excess grout includes a hollow handle adapted to be gripped by a human hand and a grout-collecting and profiling blade is secured to a first end of the handle. The blade has a breadth greater than a diameter of the handle and the blade has a length greater than its breadth.

Accordingly, a large quantity of excess grout may be collected atop the blade. Moreover, the blade has utility in profiling grout after excess grout has been removed.

Advantageously, the excess grout remover is a tool formed of a material having a specific gravity less than one so that it floats in fresh water.

The blade is flat and has a top surface, a bottom surface, a leading edge and a trailing edge, and a pair of side edges. The excess grout remover tool has a first position where the top surface faces upwardly and the tool has a second, inverted position where the bottom surface faces upwardly. A wedge-shaped top sidewall is mounted to each of the side edges and has a leading end coincident with the leading edge and has a trailing end spaced vertically from the trailing edge.

A wedge-shaped bottom sidewall is mounted to each of the side edges. The wedge-shaped bottom sidewall has a leading end coincident with the leading edge and has a trailing end spaced vertically from the trailing edge.

The top sidewalls retain excess grout atop the top surface of the blade when the excess grout remover tool is in the first position and the bottom sidewalls retain excess grout atop the bottom surface of the blade when the tool is in the second position.

A transversely disposed top trailing wall is secured to the trailing edge in upstanding relation thereto and a transversely disposed bottom trailing wall is secured to the trailing edge in depending relation therefrom.

The novel combination tool of this invention includes a handle adapted to be gripped by a human hand and the just-described blade of the excess grout remover secured to a first end of the handle. The blade has a breadth greater than a diameter of the handle and has a length greater than said breadth.

The first embodiment further includes a novel four-armed tool having a plus sign (+) structure secured to a second end of the handle, together with a spherical grout and caulk packer that is also secured to the second end of the handle in axially spaced apart relation to the four-armed tool so that the four-armed tool and the packer do not interfere with one another.

The four-armed tool has four arms of differing widths that radiate outwardly from a central base. The central base is centrally apertured to receive a stem that forms a part of the spherical packer tool.

The second end of the handle is internally threaded along its longitudinal axis.

The spherical packer is mounted on a distal free end of a machine bolt and the machine bolt extends through the central aperture formed in the four-armed tool and into screw-threaded engagement with internal threads formed in the second end of the handle.

The spherical packer is therefore longitudinally spaced from the four-armed tool by a distance substantially equal to an unthreaded extent of the machine bolt.

In a second embodiment, the large flat blade of the first embodiment is mounted to a first end of a handle and a "V"-shaped profiler tool is mounted to a second end of the handle, in lieu of the four-armed tool and the packer. The "V"-shaped profiler has a notch formed in its leading end for forming a bead in grout or caulk. This embodiment has the advantage of enabling the installer to remove excess grout with the flat blade at the leading end of the tool and applying a profile to the remaining grout with the "V"-shaped profiler tool at the trailing end of the tool at the same time.

An important advantage of this invention is that it provides an excess grout-removing and profiling tool that removes substantially larger quantities of grout per stroke than a conventional screwdriver when used as a grout remover.

An advantage closely related to the foregoing advantage is that it provides a grout removing and profiling tool that floats in water so that it is easy to retrieve if dropped into a water-filled bucket.

Another important advantage is the provision a combination tool having a grout remover and profiler tool at a first end and a dual function (excess grout removing and grout joint spacing) tool and a packer tool at a second end.

An advantage closely related to the foregoing advantage is the provision of such a tool where the excess cement remover and joint spacer tool and the packer tool are longitudinally spaced apart from one another so that they do not interfere with one another when either of them is in use.

Another advantage resides in the second embodiment where an improved excess grout remover is combined with a "V"-shaped profiler.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 5A is a perspective view of the first embodiment;

FIG. 5C is a perspective view of a plurality of the spherical packer members of the first embodiment;

DETAILED DESCRIPTION OF THE PREFERRED EMBODIMENT

Figure 1:
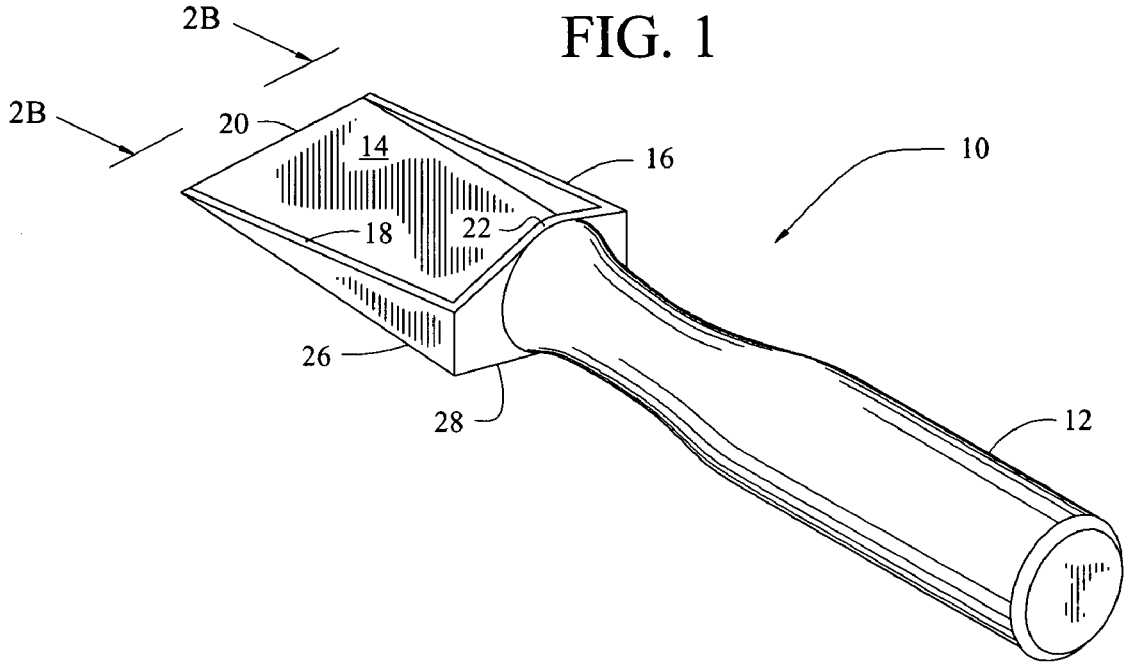
FIG. 1 is a perspective view of a grout/caulk remover that forms a part of the first embodiment.
Figure 2A:
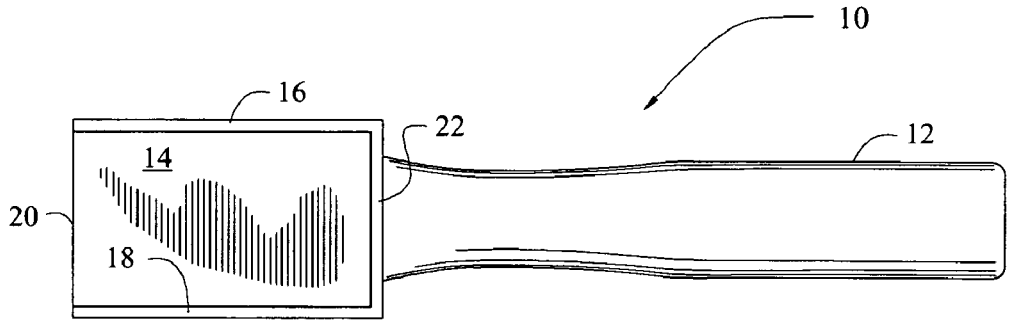
FIG. 2A is a top plan view thereof.
Figure 2B:
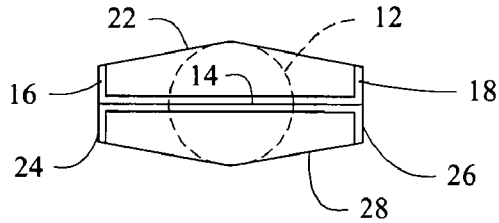
FIG. 2B is a front end view thereof, taken along line 2B-2B in FIG. 1.

Referring now to FIG. 1, it will there be seen that the reference numeral 10 denotes a first illustrative embodiment of the present invention as a whole. A plan view thereof is provided in FIG. 2A and FIG. 2B provides an end view.

Novel tool 10 includes a hollow handle 12 formed of a material having a specific gravity less than one (1.0) so that it floats in fresh water at room temperature.

A broad, flat blade 14 extends from a first end of hollow handle 12.

Wedge-shaped top sidewalls 16, 18 have their respective lowermost ends coincident with leading edge 20 of flat blade 14. Their respective elevated ends are interconnected to one another by transversely disposed upper back wall 22.

Wedge-shaped bottom sidewalls 24, 26 also have their respective lowermost ends coincident with leading edge 20 of flat blade 14. Their respective elevated ends are interconnected to one another by transversely disposed lower back wall 28.

In a preferred embodiment, upper back wall 22 and lower back wall 28 are elevated at their respective mid-lengths relative to their respective opposite ends.

Accordingly, a user can scrape relatively large quantities of excess grout onto either side of flat blade 14 by making a continuous, uninterrupted motion. The excess grout has ample room to accumulate atop the flat blade, and spillage therefrom is substantially prevented by top side walls 16, 18 and upper back wall 22 when a first side of the flat blade is used and by bottom side walls 24, 26 and lower back wall 28 when the tool is inverted and a second side of the flat blade is used.

The novel excess grout remover thus has much more capacity than the blade of a flathead screwdriver. It also has utility as a grout and caulk profiler.

Advantageously, the novel excess grout remover is formed of plastic. Thus, it does not mar the surface over which it is scraped during the excess grout-removing process.

The plastic has a specific gravity less than one (1.0) so that it floats if dropped into a bucket of water. Air entrapped within hollow handle 12 also adds buoyancy to tool 10.

Figure 3:
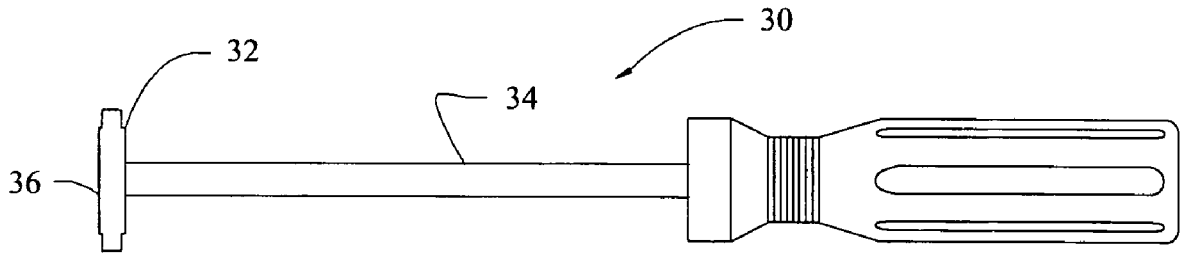
FIG. 3 is a side elevational view of a cement remover of the prior art.

FIG. 3 depicts a cement bleeder-remover 30 of the prior art. Metallic head 32 has a triangular configuration and is secured to stem 34 by bolt 36. Metallic head 32 has no utility as a grout joint spacer.

Figure 4:
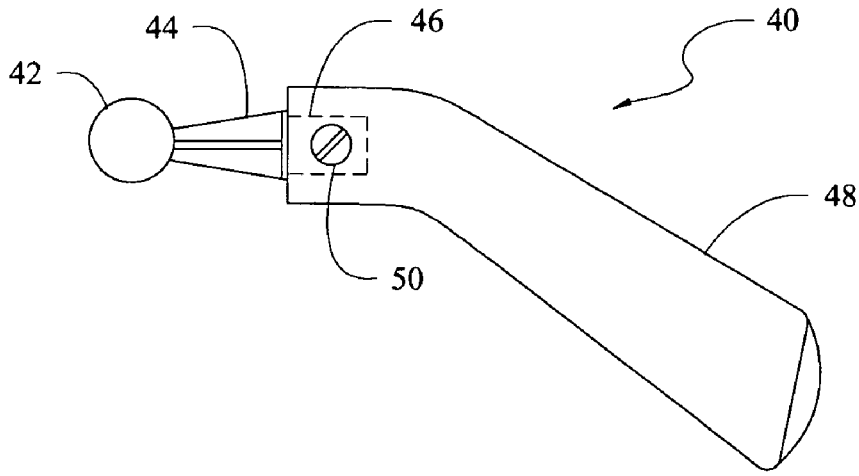
PRIOR ART FIG. 4
FIG. 4 is a side elevational view of a grout/caulk packer of the prior art.

FIG. 4 depicts a grout/caulk packer 40 of the prior art. Spherical member 42 surmounts pedestal 44 and said pedestal surmounts base 46 positioned within the hollow interior of handle 48. Transversely disposed screw 50 retains base 46 within said hollow handle 48 so that pedestal 44 is fixedly secured to the distal end of said handle.

Figure 5B:
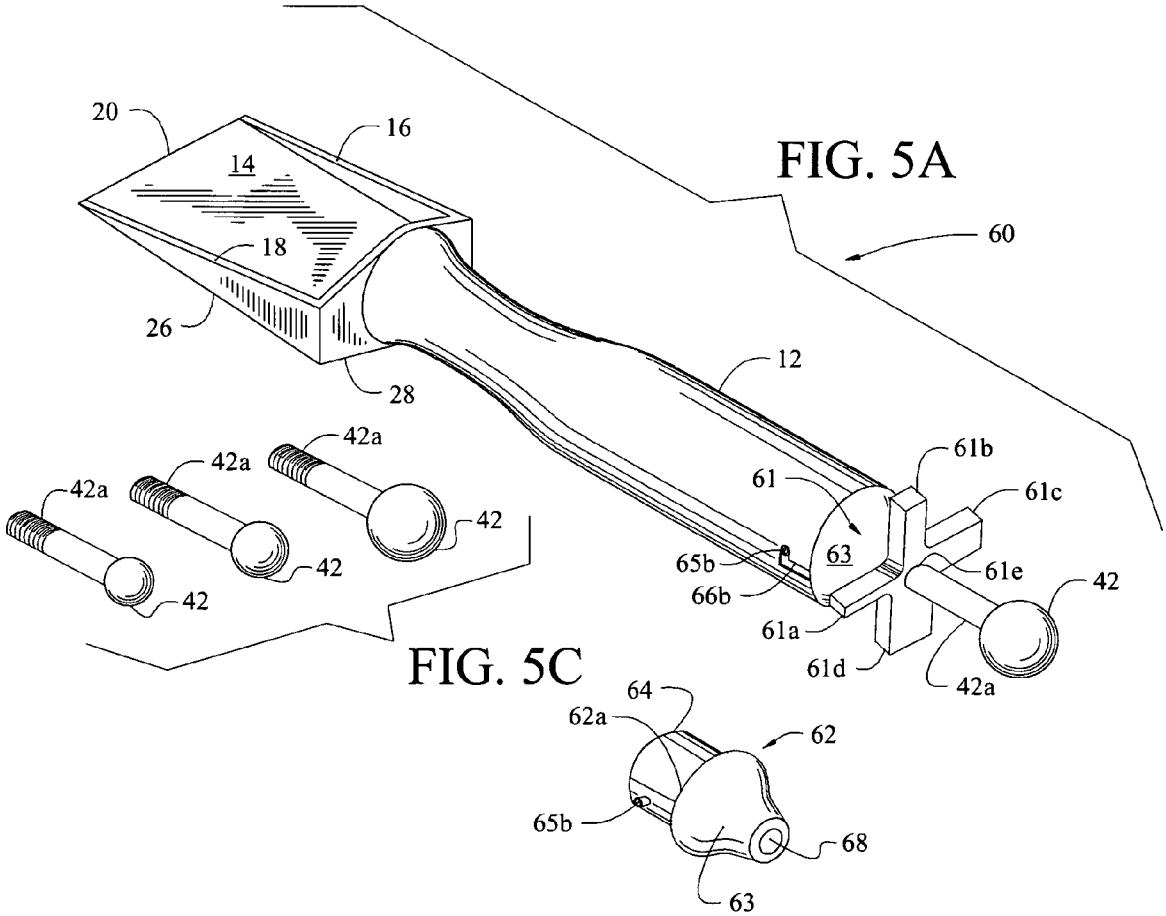
FIG. 5B is a perspective view of a connector member used in the first embodiment.
Figure 6:
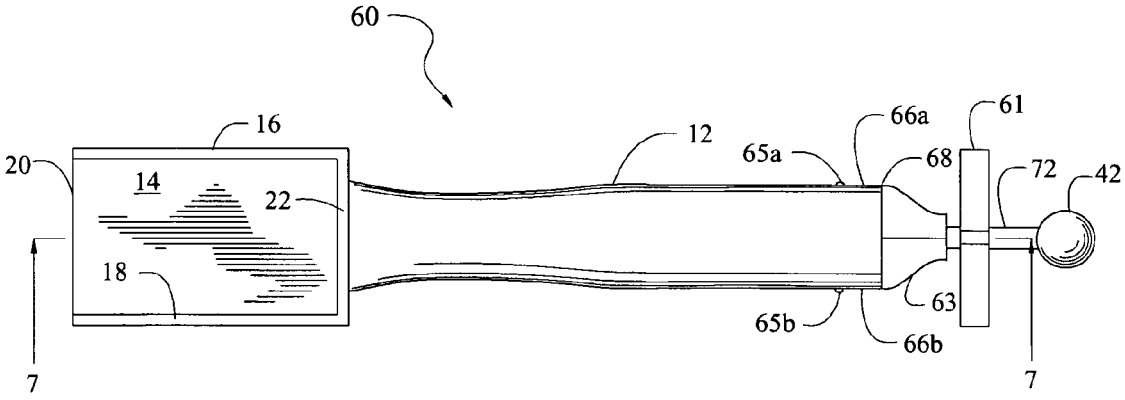
FIG. 6 is a top plan view of the first embodiment.

FIG. 5A depicts the first embodiment 60 of the novel combination tool in perspective view and FIG. 6 depicts said tool in plan. Tool 60 includes hollow handle 12 and excess grout remover blade 14 at its leading end. It further incorporates a novel four-armed excess cement-remover and grout joint spacer 61 at a second, trailing end thereof.

Novel four-armed tool 61 has four arms 61*a*, 61*b*, 61*c*, and 61*d* that extend radially from a central base of said tool 61. Central aperture 61*e* (FIGS. 5A and 7) is formed in said central base. Each arm has a square cross-section so that its width and depth (or thickness) are the same. However, the width is the significant dimension because the depth of each arm is essentially irrelevant. Thus, a rectangular rather than square cross-section is also within the scope of this invention. Each arm has a length sufficient to enable it to be placed between contiguous tiles to a depth that enables it to clean excess cement from the space between said tiles. As used herein, the term "depth" when applied to an arm of the four arms refers to the dimension into or out of a plane of paper when the width of an arm is in the plane of the paper. The term "depth" when applied to the excess cement removal process refers to the extent to which an arm is inserted into the excess cement to be removed. The greater the depth of insertion, the more excess cement is removed.

In this particular embodiment, arm 61*a* has a width of 1/16", arm 61*b* has a width of 1/8", arm 61*c* has a width of 3/16", and the width of arm 16*d* is 1/4". Accordingly, when a preselected arm is used to remove excess cement, the spacing between contiguous tiles is also set. Thus two jobs are performed at once. Further time is saved because there is no need to insert conventional spacers into place after the excess cement removal process has ended, and to remove such spacers the following day.

Cement often "bleeds" to the surface during a tile installation job, passing into the space between tiles and filling the space where grout is to be applied. The novel four-armed tool is effective in scraping off the unwanted cement when bleeding occurs. The tool also has utility in removing cement from areas where tile is chipped.

Moreover, the square shape of each arm enables the tool to be used to gauge grout joint width. Its use can therefore facilitate the tile installation procedure. For example, where each tile is to be positioned 1/8" from its contiguous tiles, the installer uses the arm of the tool that has a breadth of 1/8" and pulls the tool between two contiguous tiles. That procedure is repeated for all of the tiles with the result that two jobs are accomplished at the same time: 1) the excess cement that has bled into the grout joints is removed, and 2) all contiguous tiles are spaced apart from one another by a common preselected distance.

Novel tool 61 thus eliminates the step of placing spacers between tiles after removing excess cement between contiguous tiles. Such spacers must be removed the following day when grout is applied in the space between the tiles. Tool 61 thus eliminates such removal step as well. In other words, instead of a first excess cement-removing step, followed by placing spacers into place, followed the next day by removing the spacers, four-armed tool 61 eliminates the spacers and performs the excess cement removal and tile spacing job at the same time.

Four-armed tool 61 is secured to the second end of handle 12 by the fastening structure best depicted in FIG. 5B.

In view of this disclosure, it is clear that four-armed tool 61 could include any number of radially-extending arms, all of which could be provided with differing widths. For example, even a one-armed tool could be provided, as could a two-armed tool, a three armed tool, a five-armed tool, and so on. Four (4) is merely the preferred number of arms.

Releasable connector 62 has a trailing end 63 and a leading end 64. Annular step 62*a* is formed where trailing end 63 meets leading end 64. Leading end 64 is received within the trailing end of hollow handle 12. Specifically, a pair of radially extending pins 65*a*, 65*b* are formed in leading end 64 and said pins are received in "L"-shaped grooves 66*a*, 66*b* formed in the trailing end of handle 12. Pins 65*a*, 65*b* are pushed straight into grooves 66*a*, 66*b*, until they reach the innermost ends thereof, at which point releasable connector 62 is rotated about the longitudinal axis of handle 12 so that said pins 65*a*, 65*b* are received within the truncate part of the "L"-shaped grooves.

Internally threaded bore 68 is formed in trailing end 63 of connector 62.

Figure 7:
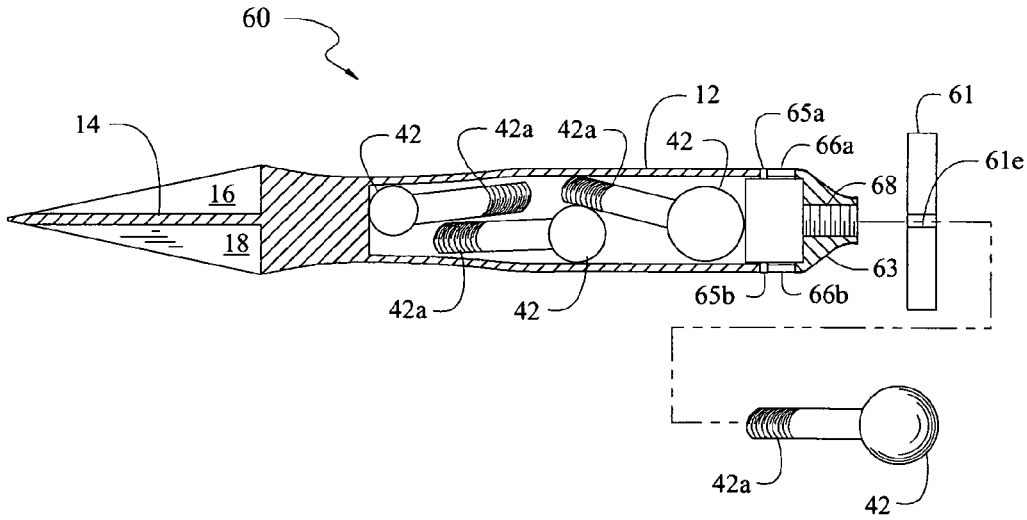
FIG. 7 is a sectional view taken along line 7-7 in FIG. 6.

FIG. 7 is an exploded view depicting how first embodiment 60 is assembled. Central aperture 61*e* formed in the central base of four-armed tool 61 is internally threaded to screwthreadedly engage machine bolt stem 42*a* of spherical member 42. Said stem 42*a* also screwthreadedly engages internally threaded bore 68 formed in trailing end 63 of connector 62.

Spherical member 42 is provided in various diameters as depicted in FIG. 5C.

FIG. 7 also indicates how the space within hollow handle 12 may be used to store a plurality of spherical members 42.

In this way, the unthreaded extent of machine bolt stem 42*a* serves as a spacer for positioning spherical member 42 in spaced relation to four-armed tool 61. The user may thus use either of said tools as desired without interference from the other.

Spherical member 42, also known as a packer, is used in a well-known way to introduce a linear concavity into grout or caulk as an aesthetic finishing touch.

Figure 8A:
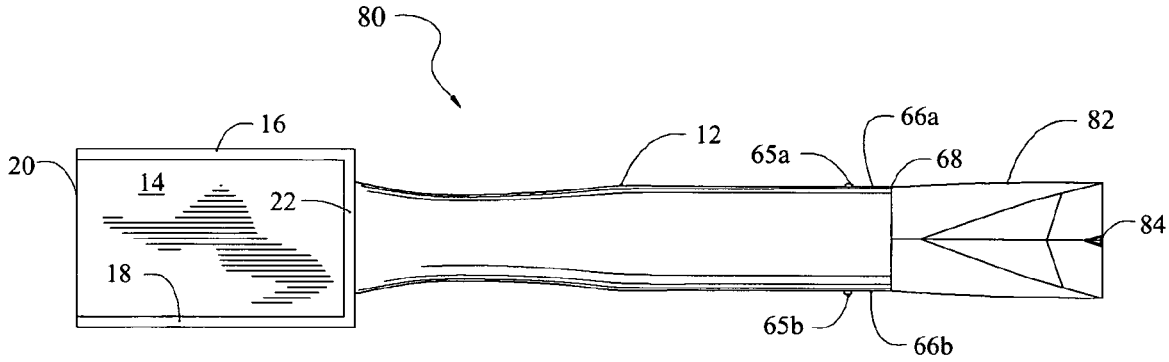
FIG. 8A is a top plan view of a second embodiment.
Figure 8B:
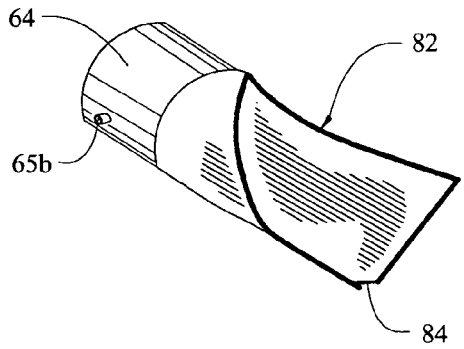
FIG. 8B is a perspective view of the profiler of the second embodiment.
Figure 9A:
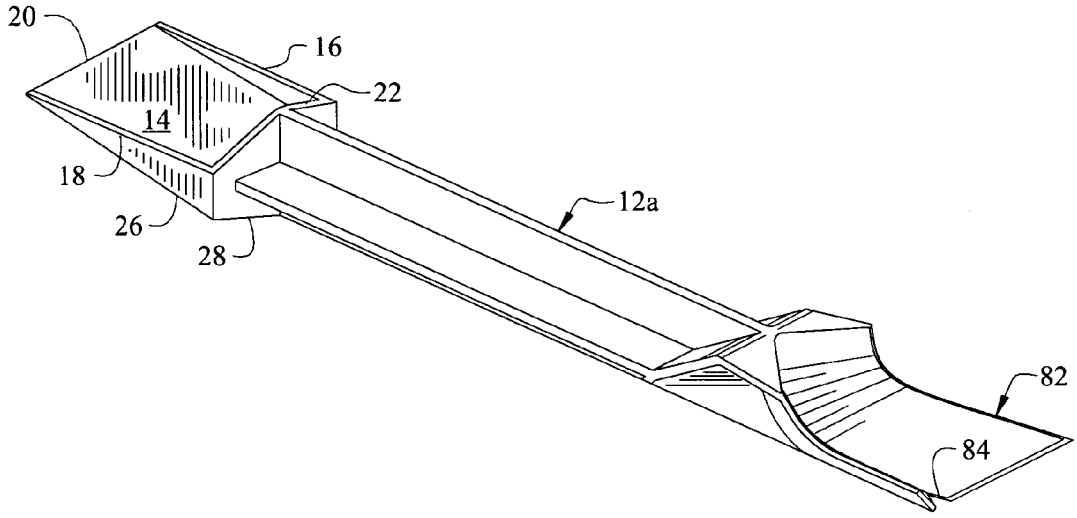
FIG. 9A is a perspective view of a variation of the second embodiment.
Figure 9B:
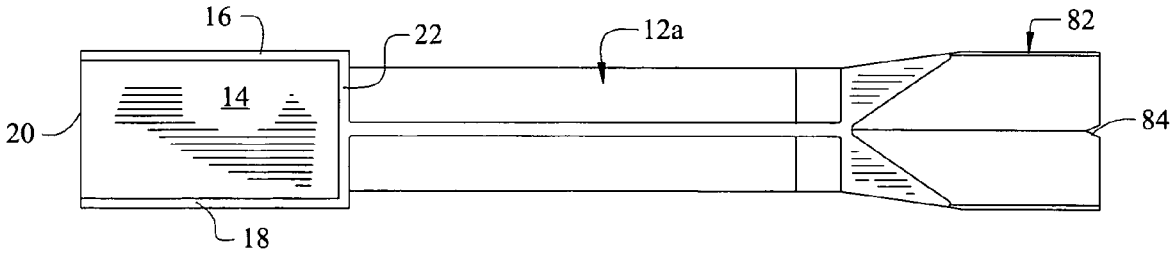
FIG. 9B is a top plan view of the structure depicted in FIG. 9A.
Figure 9C:
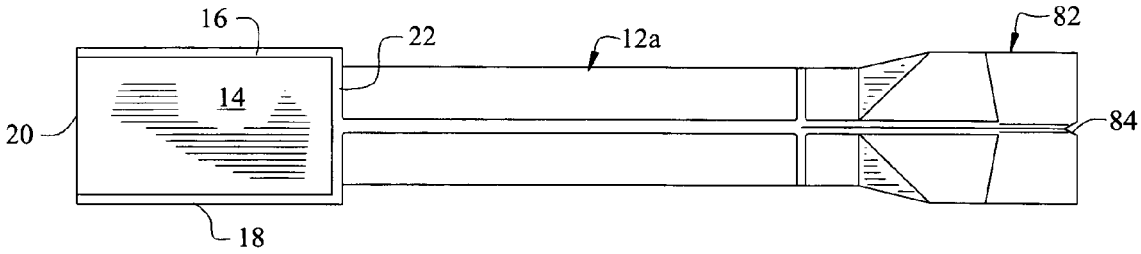
FIG. 9C is a bottom plan view of the structure depicted in FIG. 9A.
Figure 9D:
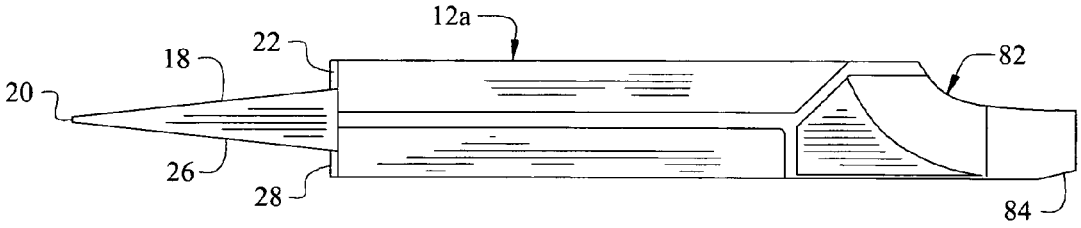
FIG. 9D is a side elevational view of the structure depicted in FIG. 9A.
Figure 9E:
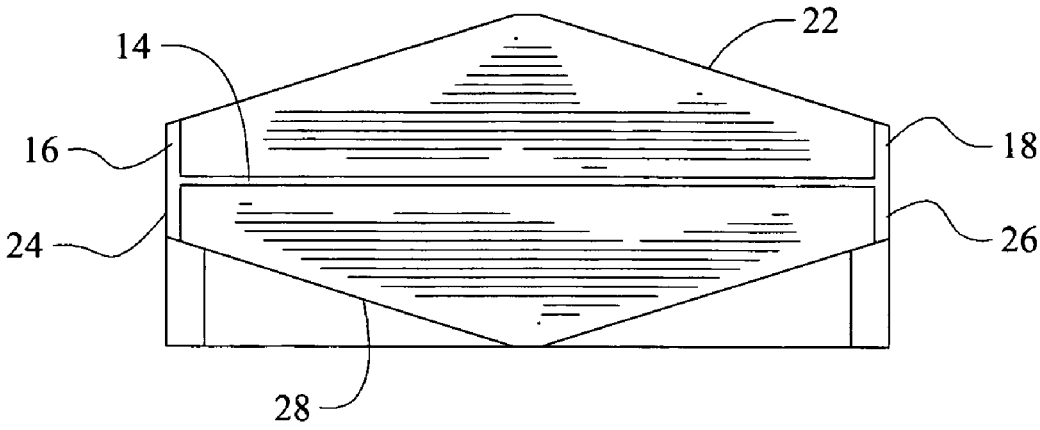
FIG. 9E is a front end view of the structure depicted in FIG. 9A.
Figure 9F:
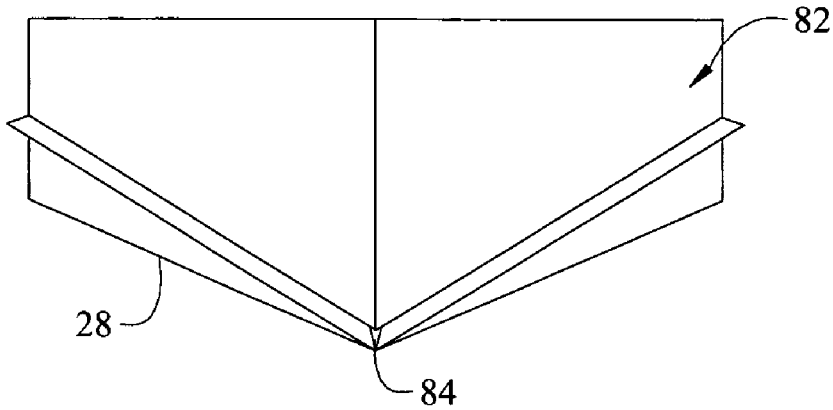
FIG. 9F is a rear end view of the structure depicted in FIG. 9A.

In the second embodiment of FIGS. 8A and 8B, profiler 82 that includes a "V"-shaped notch 84 formed therein supplants four-armed tool 61 and spherical member 42. Attachment 82 is integrally formed with base 64 having a pair of diametrically opposed, radially extending locking pins 65*a*, 65*b* (FIG. 8A), only one of which is visible in the perspective view of FIG. 8B. Thus, base 64 has the same construction as in the first embodiment.

In a variation of the second embodiment, depicted in FIGS. 9A-F, handle 12*a* has a web construction and is not hollow as is handle 12. Moreover, profiler 82 is formed integrally with said handle 12*a*, there being no base 64 and locking pins 65*a*, 65*b* in this variation of the second embodiment. The web construction of handle 12*a* has a plus-sign-shaped transverse cross section. Due to the non-hollow structure of handle 12*a*, the combination tool of FIGS. 9A-F may be buoyant or non-buoyant, depending upon the material selected to construct the tool.

Tool 10 of FIGS. 1-3, having hollow handle 12 and wide blade 14 at it leading end, is modified by forming "L"-shaped grooves 66*a*, 66*b* in the trailing end of said handle so that base 64 of attachment 62, having radially extending pins 65*a*, 65*b* formed therein, may releasably engage said "L"-shaped grooves, thereby releasably locking said "V"-shaped profiler to the trailing end of handle 12.

Both embodiments of the novel combination tool include the wide-bladed excess grout remover and profiler at the leading end of the tool. The first embodiment includes the novel four-armed tool and the spherical packer at the second end whereas the second embodiment includes the "V"-shaped profiler at said second end.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A tool having utility in tile installation, comprising:

a handle adapted to be gripped by a human hand;

a blade adapted to remove excess grout and caulk being secured to a first end of said handle;

said blade having a breadth greater than a diameter of said handle;

said blade having a length greater than said breadth;

said blade being flat and having a top surface, a bottom surface, a leading edge and a trailing edge, and a pair of side edges;

said tool having a first position where said top surface faces upwardly and said tool having a second, inverted position where said bottom surface faces upwardly;

a wedge-shaped top sidewall mounted to each of said side edges, said wedge-shaped top sidewall having a leading end coincident with said leading edge and having a trailing end spaced vertically from said trailing edge;

a wedge-shaped bottom sidewall mounted to each of said side edges, said wedge-shaped bottom sidewall having a leading end coincident with said leading edge and having a trailing end spaced vertically from said trailing edge;

whereby said top sidewalls are adapted to retain excess grout and caulk atop said top surface of said blade when said tool is in said first position;

whereby said bottom sidewalls are adapted to retain excess grout and caulk atop said bottom surface of said blade when said tool is in said second position; and whereby a large quantity of excess grout and caulk may be collected atop said blade.

2. The tool of claim 1, further comprising:

said tool formed of a material having a specific gravity less than one so that said tool floats in fresh water.

3. The tool of claim 1, further comprising:

a transversely disposed top trailing wall secured to said trailing edge in upstanding relation thereto; and a transversely disposed bottom trailing wall secured to said trailing edge in depending relation therefrom.

4. A tool, comprising:

a handle adapted to be gripped by a human hand;

a blade adapted to remove excess grout secured to a first end of said handle;

said blade having a breadth greater than a diameter of said handle;

said blade having a length greater than said breadth;

a four-armed cement remover and grout joint spacer secured to a second end of said handle; and a spherical packer secured to said second end of said handle in longitudinally spaced relation to said four-armed cement remover and grout joint spacer;

whereby excess cement between tiles is removed and contiguous tiles spaced apart from one another by a predetermined distance by using said four-armed excess cement remover and grout joint spacer and grout is packed by using the spherical grout packer, respectively, at said second end of said combination tool.

5. The tool of claim 4, further comprising:

a connector having a leading end slideably disposed with a trailing end of said hollow handle and having a trailing end;

said connector having a longitudinally disposed bore formed in said trailing end, said longitudinally disposed bore being internally threaded along its extent;

said four-armed tool including four arms that radiate outwardly relative to a central base of said four-armed tool;

a central aperture formed in said central base of said four-armed tool;

said spherical packer being mounted on a distal free end of a bolt having a threaded extent and an unthreaded extent;

said bolt extending through said central aperture formed in said central base of said four-armed tool and into screw-threaded engagement with said internal threads formed in said trailing end of said connector;

whereby said spherical packer is longitudinally spaced from said four-armed tool by a distance substantially equal to said unthreaded extent of said bolt.

6. A combination tool, comprising:

a handle adapted to be gripped by a human hand;

said handle having a web construction and said web having a plus-sign-shaped transverse cross-section:

a blade adapted to remove excess grout and caulk secured to a first end of said handle;

a "V"-shaped grout and caulk profiler secured to a second end of said handle;

a notch formed in a leading edge of said "V"-shaped grout and caulk profiler;

said notch being operative to form a bead in grout when said "V"-shaped grout and caulk profiler is dragged along an extent of uncured grout or caulk.

7. A combination tool, comprising:

a handle adapted to be gripped by a human hand;

said handle having a web construction and said web having a plus-sign-shaped transverse cross-section:

a blade adapted to remove excess grout and caulk being secured to a first end of said handle;

a "V"-shaped grout and caulk profiler formed integrally with a second end of said handle;

a notch formed in a leading edge of said "V"-shaped grout and caulk profiler;

said notch being operative to form a bead in grout when said "V"-shaped grout and caulk profiler is dragged along an extent of uncured grout or caulk.

8. A multi-function tool having utility in tile installation procedures, comprising:

a central base;

at least one arm that extends radially from said central base;

said at least one arm having a predetermined width;

said at least one arm including four arms;

each arm of said four arms having a length sufficient to enable it to be placed between contiguous tiles to a depth that enables said arm to clean excess cement from the space between said tiles and to space said tiles from one another;

each arm of said four arms having a different width;

whereby said tool performs a cement-removing function and a grout joint spacer function.

9. The multi-function tool of claim 8, further comprising:

a central aperture formed in said central base to facilitate connection of said multi-function tool to a preselected multi-function tool that incorporates said multi-function tool having at least one arm.

10. The multi-function tool of claim 8, further comprising:

a first arm of said four arms having a width of 1/16";

a second arm of said four arms having a width of 1/8";

a third arm of said four arms having a width of 3/16"; and a fourth arm of said four arms having a width of 1/4".

whereby when a preselected arm is used to remove excess cement, the spacing between contiguous tiles is also set.

* * * * *